United States Patent [19]

Perkins

[11] 3,999,750

[45] Dec. 28, 1976

[54] ARTIFICIAL SNOWFALL PRODUCING APPARATUS

[76] Inventor: Willis E. Perkins, 9223 Freeport Drive, Dallas, Tex. 75228

[22] Filed: Dec. 8, 1975

[21] Appl. No.: 638,602

[52] U.S. Cl. ..... 272/15; 40/106.25; 137/268; 222/195

[51] Int. Cl.[2] ..... A63J 5/02

[58] Field of Search ..... 272/15, 8 R, 8 F, 8 N, 272/27 R, 27 B, 27 N, 27 W, 2; 273/95 R, 95 C, 96 R, 96 C; 40/37, 106.21, 106.22, 106.23, 106.25; 302/2 A, 53, 56; 239/142, 143, 654, 655; 222/195, 4; 214/17 R, 17 A, 17 D; 137/268

[56] References Cited

UNITED STATES PATENTS

| | | | |
|---|---|---|---|
| 1,101,422 | 6/1914 | Fielding | 272/15 UX |
| 1,776,196 | 9/1930 | Rochwarg | 273/95 C |
| 2,282,828 | 5/1942 | Root | 239/655 |
| 2,292,897 | 8/1942 | Nielsen | 222/195 X |
| 2,543,606 | 2/1951 | Solomon et al. | 272/15 X |
| 2,906,169 | 9/1959 | Saffir | 272/15 UX |
| 3,134,513 | 5/1964 | Ashman | 222/195 X |
| 3,179,379 | 4/1965 | Grün et al. | 222/195 X |
| 3,204,942 | 9/1965 | Matthys et al. | 222/195 X |
| 3,415,513 | 12/1968 | Burnbaum | 272/15 |

*Primary Examiner*—Richard C. Pinkham
*Assistant Examiner*—Arnold W. Kramer
*Attorney, Agent, or Firm*—Giles C. Clegg, Jr.

[57] ABSTRACT

An artificial snow machine for display purposes includes a cylindrical container having an inverted conically shaped bottom. High pressure air is admitted to the interior of the container through a port at the apex of the cone to pressurize the container. A motor driven fan is mounted on the top of the container, the fan blades being inside the container. A plurality of rotatable elbows provide communication from the interior to the exterior of the container through the sides and near the top thereof. The container is adapted to be filled with artificial snow material, such as small plastic pellets, to a level approximately two-thirds the height of the container. Circulating air from the fan blades churn and suspend some of the pellets, some of which are carried from the pressurized container by the escaping air. A shroud around the fan blades prevents pellets from striking the blades. Pellets leaving the elbows, or hoses connected thereto, form a screen as they fall.

7 Claims, 2 Drawing Figures

ARTIFICIAL SNOWFALL PRODUCING APPARATUS

BACKGROUND OF THE INVENTION

This invention relates to display apparatus and, more particularly, to apparatus for creating the aesthetically pleasing effect of falling snow.

There are many instances where it is desired to create the effect of falling snow without making artificial snow by mixing water with a refrigerant material. For example, during the Christmas shopping season, many stores provide attractive window displays showing a winter scene. To enhance the winter-like atmosphere of the display, some means of achieving the effect of falling snow would be desirable. A further example of when such an effect would be desirable is on a movie set wherein a particular scene requires the effect of falling snow but it would be particularly burdensome to film the scene in an actual winter climate.

Prior attempts to achieve the effect of falling snow have not proved entirely satisfactory. Such attempts have failed to achieve, for example, a uniform dispersion of the artificial snow material as it falls.

It is therefore an object of this invention to provide apparatus for creating the effects of falling snow.

Another object of this invention is to provide such apparatus utilizing lightweight snow-like plastic particles which are uniformly distributed in the air to provide the appearance of a uniform snowfall.

SUMMARY OF THE INVENTION

The foregoing and additional objects of this invention are attained by providing an enclosed container adapted to hold a supply of small plastic pellets. Means are provided to cause pellets to fill the space between the top of the container and the pellet supply. A plurality of elbows provide communication between the interior and exterior of the container. High pressure air admitted into the bottom of the container causes the pellets in the empty space of the container to be expelled out of the container through the elbow members. Hoses connected to the elbow members then direct the pellets to the display area. The effect produced is a screen of falling pellets, much like a waterfall, with the density of the falling pellets being substantially the same across the entire distance that they are thrown when ejected from the hose.

DESCRIPTION OF THE DRAWING

The foregoing will be more readily apparent upon reading the following description in conjunction with the drawing in which.

DESCRIPTION OF THE PREFERRED EMBODIMENT

Figure 1:
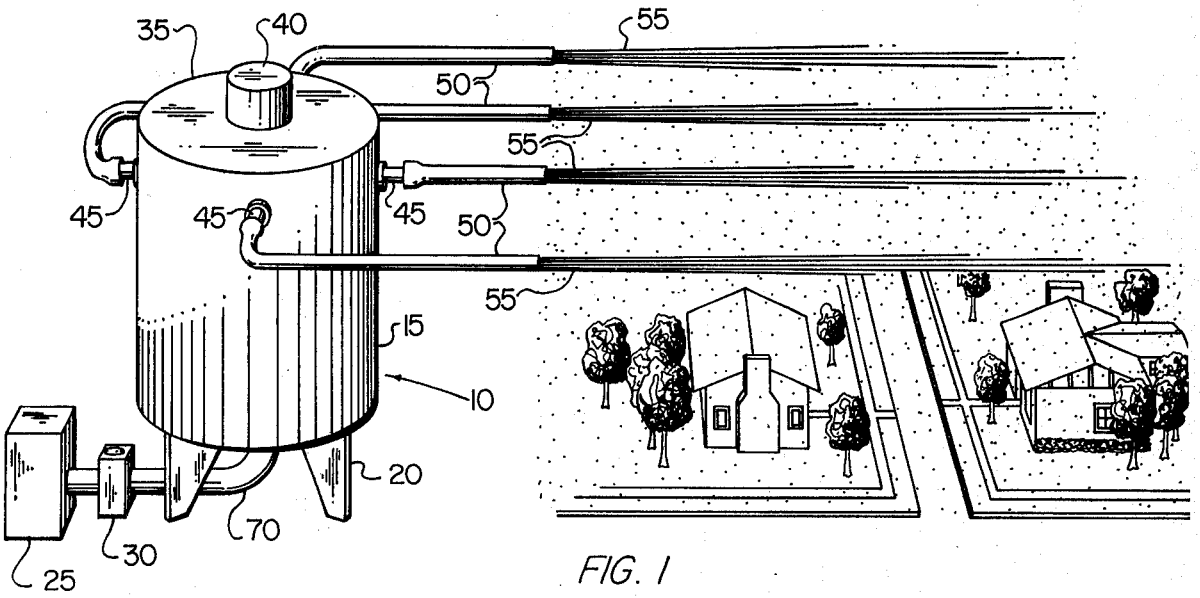
FIG. 1 depicts a perspective view of a display utilizing apparatus constructed in accordance with the principles of this invention.

Referring now to FIG. 1, depicted therein, although not to scale, is a display scene wherein apparatus 10 constructed in accordance with the principles of this invention is utilized to create the effect of falling snow. Apparatus 10 illustratively includes a cylindrical housing 15 mounted on a base member 20. A source of pressurized air 25 is connected to base member 20 through pressure regulating valve 30. Mounted on the cover 35 of housing 15 is fan motor 40, fan blades coupled to motor 40 being inside container 15. Extending through container 15 are a plurality, illustratively four, of rotatable elbow pipe members 45 and connected to elbow members 45 are hoses 50.

In operation, container 15 is filled approximately one-third from the top with polystyrene pellets of approximately 1/16 inch diameter. In a manner to be described hereinafter with particular reference to FIG. 2, when pressurized air from source 25 is admitted into the bottom of container 15 and fan motor 40 is turned on, the polystyrene pellets are forced out of container 15 through hoses 50 from which they are ejected to form elongated clouds 55 of the pellets. The pellets fall from the clouds 55 to produce a screen-like effect of falling pellets. It has advantageously been found that when utilizing apparatus 10 constructed in accordance with principles of this invention the density of the falling pellets is substantially the same across the entire distance that they are thrown when ejected from the hose. This distance, the width of the screen, is controlled by controlling the pressure of the air admitted into the bottom of container 15. The density of the pellets in the screen is controlled by varying the speed of fan motor 40 and by rotating elbow members 45, as will be described hereinafter.

Figure 2:
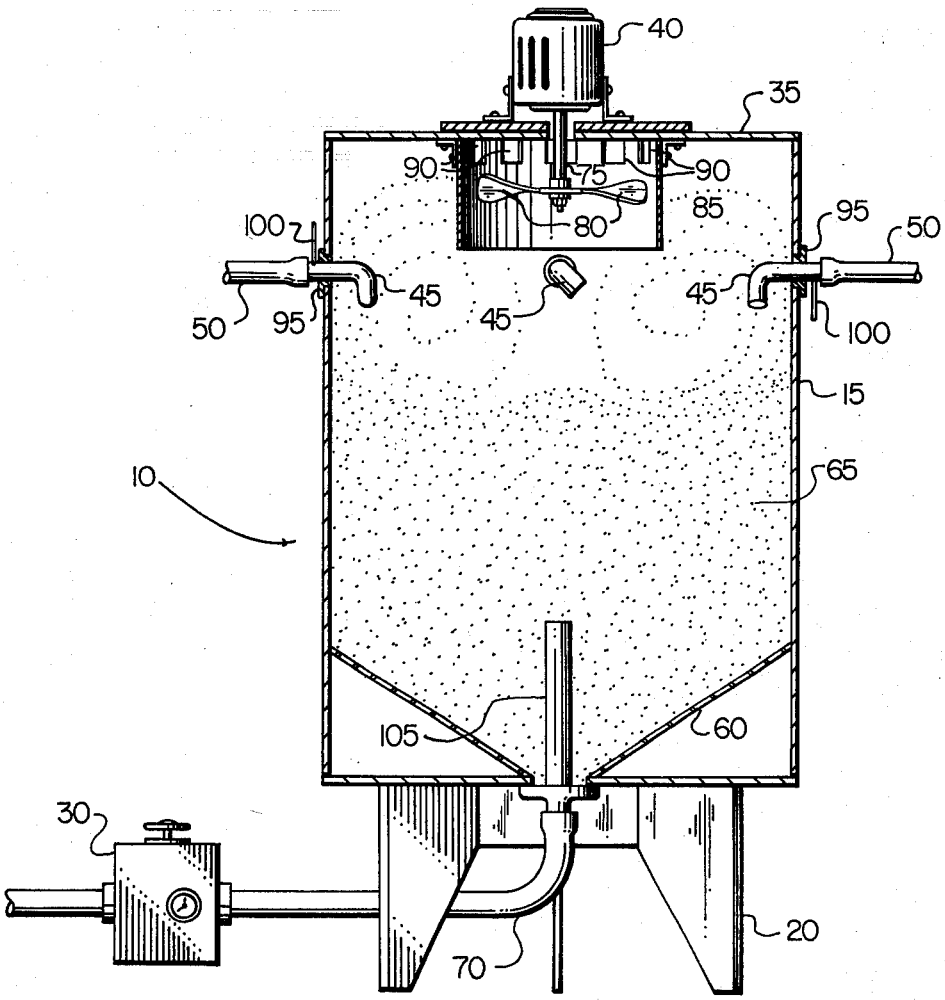
FIG. 2 depicts a vertical cross-sectional view of apparatus constructed in accordance with the principles of this invention.

FIG. 2 depicts a vertical cross-sectional view of illustrative apparatus 10 wherein cylindrical container 15 is fitted with an inverted conical shaped bottom 60 and is filled approximately two-thirds full with polystyrene pellets 65, preferably approximately 1/16 inch diameter. Pressurized air from source 25 is regulated by valve 30 and enters the bottom 60 of housing 15 through hose 70 suitably clamped to fittings. Hose 70 is connected to standpipe 105. Motor 40 is mounted on the cover 35 of housing 15 and its shaft 75 extends through an opening in cover 35 into the interior of container 15. Fan blades 80 are suitably mounted to the lower end of shaft 75 for rotation therewith. Fan blades 80 are surrounded by a cylindrical shroud member 85 open at its lower end and having openings 90 cut in its upper end. Shroud member 85 is mounted on cover 35. Rotatable elbow members 45, illustratively four in number, extend through openings in container 15 and are held for rotation in suitable bearing members 95. Elbow members 45 may be fitted with handles 100 so that they may be readily rotated, in accordance with the desired effect, as will be described hereinafter.

In operation, fan motor 40 is connected to a suitable source of electric power (not shown), causing fan blades 80 to spin. The spinning of fan blades 80 causes air currents to circulate in the space between cover 35 and pellet supply 65. Pellets 65 are extremely lightweight and have very little inertia so that the circulating air currents churn the pellets and cause the space to be filled with moving pellets. The purpose of cylindrical shroud member 85 is to keep the pellets away from fan blades 80, openings 90 allowing the air to circulate therethrough. The high pressure air entering housing 15 through hose 70 and pipe 105 causes the circulating pellets to be ejected from housing 15 through elbow member 45. Pipe 105 reduces the pressure requirement on the entering air because the air meets less pellet resistance in its travel.

It has been found that by increasing the pressure of the pressurized air, the length of elongated clouds 55

(FIG. 1) is increased, thereby increasing the width of the screen of pellets falling therefrom. In a preferred embodiment a vacuum motor connected to discharge air into apparatus 10 has been utilized as pressure source 25. Valve 30 may then be an economical and simply constructed bypass valve. Since the apparatus may be required to run for several hours, the use of a vacuum motor as source 25 may be preferred to other sources of pressurized air, such as tanks or cylinders of compressed air. In an operative embodiment where container 15 is a cylindrical drum approximately 48 inches high and 30 inches in diameter, a single load of pellets has been found to provide a suitable snow fall display for about six hours, dependent upon the desired rate of snowfall.

The density of the pellets in the clouds 55 and the resulting screens may be controlled by varying the speed of fan blades 80, the greater the fan speed the more pellets that circulate in the open space near the top of container 15. In addition, the density of the screen may be also controlled by rotating elbow members 45 so that their openings present a greater or lesser effective cross-sectional area open to the pellets circulating in the open space near the top of container 15.

Although not entirely understood, it has been found that the screen of falling pellets from the clouds 55 has a substantially uniform density across the entire width of the screen. It is thought that the reason for the effect is that the pellets have a very low inertia as they are ejected from the end of hoses 50 and immediately start falling as soon as they encounter any resistance. The stream of pellets leaving the end of hoses 50 may be considered as having its outer "skin" layers stripped off uniformly as the distance from the ends of the hoses is increased.

Accordingly, there has been described an improved artificial snow machine for display purposes. It is understood that while only a preferred embodiment of this invention has been described herein, numerous other variations, modifications and adaptations of the present invention will be apparent to those skilled in the art and such as come within the spirit and scope of the appended claims are considered to be embraced by the present invention.

What is claimed is:

1. Apparatus for producing the effect of falling snow comprising:

a closed container adapted to hold a quantity of relatively lightweight pelletized material, said container including and a cover member a bottom member having an opening therethrough and a cover member;

means adapted to connect a source of pressurized air to said bottom member opening;

fan means mounted on said cover member inside said container for blowing air downwardly onto said pelletized material with the circulating air currents caused by said fan means churning said pelletized material and causing pellets to be entrained in the circulating air currents; and at least one exit member extending through the wall of said container near the top thereof with the escape of said pressurized air from said at least one exit member carrying some of the entrained pellets therewith.

2. The apparatus of claim 1 wherein each said exit member includes means for varying the effective open area of said exit member.

3. The apparatus of claim 2 wherein each said exit member comprises an elbow pipe and said varying means includes means for rotating said elbow pipe.

4. The apparatus of claim 1 further including hose means connected to each said exit member for directing the pelletized material from said apparatus to a location remote from said apparatus.

5. The apparatus of claim 1 wherein said connecting means includes means for varying the pressure of air entering said bottom member.

6. The apparatus of claim 1 further including means for preventing said pelletized material from contacting said fan means.

7. The apparatus of claim 6 wherein said preventing means includes a cylindrical shroud member surrounding said fan means and mounted on the inside of said cover member, said shroud member having openings therethrough for allowing circulation of air about said fan means.

* * * * *